US006966383B2

(12) United States Patent
Milberger et al.

(10) Patent No.: US 6,966,383 B2
(45) Date of Patent: Nov. 22, 2005

(54) HORIZONTAL SPOOL TREE WITH IMPROVED PORTING

(75) Inventors: Lionel J. Milberger, Houston, TX (US); Morris B. Wade, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 10/730,799

(22) Filed: Dec. 9, 2003

(65) Prior Publication Data

US 2004/0112604 A1 Jun. 17, 2004

Related U.S. Application Data

(60) Provisional application No. 60/433,341, filed on Dec. 12, 2002.

(51) Int. Cl.[7] ..... E21B 33/068; E21B 34/02

(52) U.S. Cl. ..... 166/368; 166/95.1; 166/97.1; 166/86.1; 166/88.1

(58) Field of Search ..... 166/368, 95.1, 166/97.1, 88.1, 86.1, 347, 88.4; 285/123.1

(56) References Cited

U.S. PATENT DOCUMENTS

| | | | | |
|---|---|---|---|---|
| 2,796,133 A | | 6/1957 | Endean et al. | |
| 2,798,558 A | | 7/1957 | McCulloch | |
| 2,889,886 A | * | 6/1959 | Gould | 166/89.3 |
| 5,544,707 A | | 8/1996 | Hopper et al. | |
| 5,706,893 A | | 1/1998 | Morgan | |
| 5,992,527 A | * | 11/1999 | Garnham et al. | 166/379 |
| 6,039,119 A | | 3/2000 | Hopper et al. | |
| 6,050,339 A | | 4/2000 | Milberger | |
| 6,227,300 B1 | | 5/2001 | Cunningham et al. | |
| 6,357,529 B1 | * | 3/2002 | Kent et al. | 166/344 |
| 6,470,968 B1 | | 10/2002 | Turner | |
| 6,497,286 B1 | * | 12/2002 | Hopper | 166/368 |
| 6,612,368 B2 | * | 9/2003 | Kent et al. | 166/75.13 |
| 6,659,181 B2 | * | 12/2003 | Hartmann | 166/348 |
| 6,755,254 B2 | * | 6/2004 | DeBerry | 166/368 |
| 2001/0011593 A1 | | 8/2001 | Wilkins | |
| 2002/0000315 A1 | | 1/2002 | Kent et al. | |
| 2002/0000322 A1 | | 1/2002 | Bartlett et al. | |
| 2002/0100592 A1 | | 8/2002 | Garrett et al. | |
| 2003/0089501 A1 | | 5/2003 | Hartman | |

FOREIGN PATENT DOCUMENTS

| | | |
|---|---|---|
| WO | WO 01/73259 | 3/2001 |

* cited by examiner

*Primary Examiner*—David Bagnell
*Assistant Examiner*—K. Thompson
(74) *Attorney, Agent, or Firm*—Browning Bushman P.C.

(57) ABSTRACT

The horizontal spool tree assembly 10 controls fluid flow through a production tubing string 18 within a well. The horizontal spool tree assembly is adapted for use with a workover string for fluid communication with the tree assembly. The spool body 12 has a central bore 14 for receiving a tubing hanger 22 therein, with a production passageway extending laterally through the spool body to a production line 36. The spool body also includes an annulus passageway extending laterally through the spool body for fluid communication between the tubing annulus 16 and the annulus line 52. The spool tree assembly has improved porting for the production line and the annulus line, and also for both workover and crossover operations.

51 Claims, 7 Drawing Sheets

HORIZONTAL SPOOL TREE WITH IMPROVED PORTING

RELATED CASE

This application claims priority from U.S. application Ser. No. 60/433,341 filed on Dec. 12, 2002.

FIELD OF THE INVENTION

This invention relates to horizontal spool trees and, more particularly, to a horizontal spool tree assembly with improved porting for the combination of the tubing annulus, the lateral production passageway, and the lines for both workover and crossover operations.

BACKGROUND OF THE INVENTION

Wells are frequently completed with a "horizontal tree", i.e., a production system which contains one or more hangers in a spool body with a lateral production passageway in fluid communication with a production tubing string, and a tree cap above the tree hanger. A port through the spool body passes production fluids from the production tubing laterally through the spool body and then to the surface via a production flow line. Retrievable plugs are commonly installed in the bores of both the tree cap and the tubing hanger. Exemplary prior art is disclosed in U.S. Pat. Nos. 5,544,707, 5,706,893, 6,050,339, 6,039,119, 6,227,300, and 6,470,968. Relevant publications are U.S. 2001/0011593, 2002/000322 2002/0000315, 2003/0089501 and WO01/73259.

Various types of equipment and techniques have been proposed for the workover of horizontal spool tree wells. Workover operations are conventionally performed utilizing a floating drilling rig with a subsea BOP connected to the top of the horizontal spool tree, and a drilling riser connected to the top of the BOP. When a big bore riser and a BOP stack are placed on top of the tree, various types of workover operations may be performed, including pulling and reinstalling the tubing. One or more workover strings provide fluid communication with the horizontal spool tree assembly, with the workover fluid passing through the tree cap and to the tubing annulus. A running tool may be used to seal off the top of the tubing hanger and to pull a plug if one is provided in the top of the tubing hanger to close off the tubing string.

Workover porting of the tubing annulus may be accomplished utilizing valves in a line extending through the tubing hanger for fluid communication with the tubing annulus. Valves external of the spool body or within the spool body have alternatively been used to route the tubing annulus line around the tubing hanger to various locations within the spool body.

Horizontal spool trees also desirably provide a crossover line between the production line and the annulus line. If for some reason the production line needs to be shut down, flow may be diverted through the crossover line to the annulus line and then to the production platform. The crossover flow line is thus located closely adjacent the horizontal spool tree assembly, and conventionally is located within twelve feet of the production bore.

Horizontal spool trees also include an annulus port and an annulus line which conventionally extends from the spool tree assembly to the production platform. The annulus line enables annulus pressure which is excessive to be bled off, thereby maintaining a desired pressure differential between the interior and the exterior of the tubing string.

The disadvantages of the prior art are overcome by the present invention, and a horizontal spool tree with improved porting is hereafter disclosed.

SUMMARY OF THE INVENTION

The present invention provides alternative configurations for porting a horizontal spool tree assembly, and particularly the tubing annulus, the production port, and the ports and lines for workover and crossover operations. These configurations do not require an annulus passageway through the tubing hanger, and thus do not require a value in the annulus bore of the tubing hanger.

In one embodiment, a horizontal spool tree assembly includes a crossover flow line in fluid communication with the annulus line between first and second annulus valves which control fluid flow between the tubing annulus and the annulus line. The crossover line is connected at the other end to the production line, and a crossover valve is positioned along the crossover flow line.

In another embodiment, a horizontal spool tree assembly includes an annulus passageway extending from the tubing annulus upward through a portion of the tubing hanger and laterally through the tubing hanger into the spool body and to the annulus line.

In yet another embodiment, the spool body production passageway is positioned above the tubing hanger and extends laterally through the spool body to the production line, while the annulus passageway below the tubing hanger extends laterally through the spool body for communication between the tubing annulus and the annulus line. The workover flow path may extend entirely within the spool body from the production passageway to the annulus passageway, or the workover flow path may be provided exterior of the spool body for fluid communication between the production line and the annulus line.

In yet another embodiment, the spool production passageway is provided above the tubing hanger, and the annulus passageway extends upward into the tubing hanger and then laterally outward through the tubing hanger and through the spool body to the annulus line.

In another embodiment, the spool body production passageway is provided above the tubing hanger and extends laterally to a production line. The workover flow path extends from the spool body central bore above the tubing hanger downward through a portion of the tubing hanger, laterally outward through the tubing hanger and into the spool body, and laterally inward through the spool body to the tubing annulus.

It is a particular feature of the horizontal spool tree assembly that various embodiments simplify the construction of the spool tree assembly by providing a workover flow path which is also used to provide a crossover flow path, so that both workover and crossover operations are conducted using at least a portion of the same flow line.

These and further features and advantages of the present invention will become apparent from the following detailed description, wherein reference is made to the figures in the accompanying drawings

Figure 3:
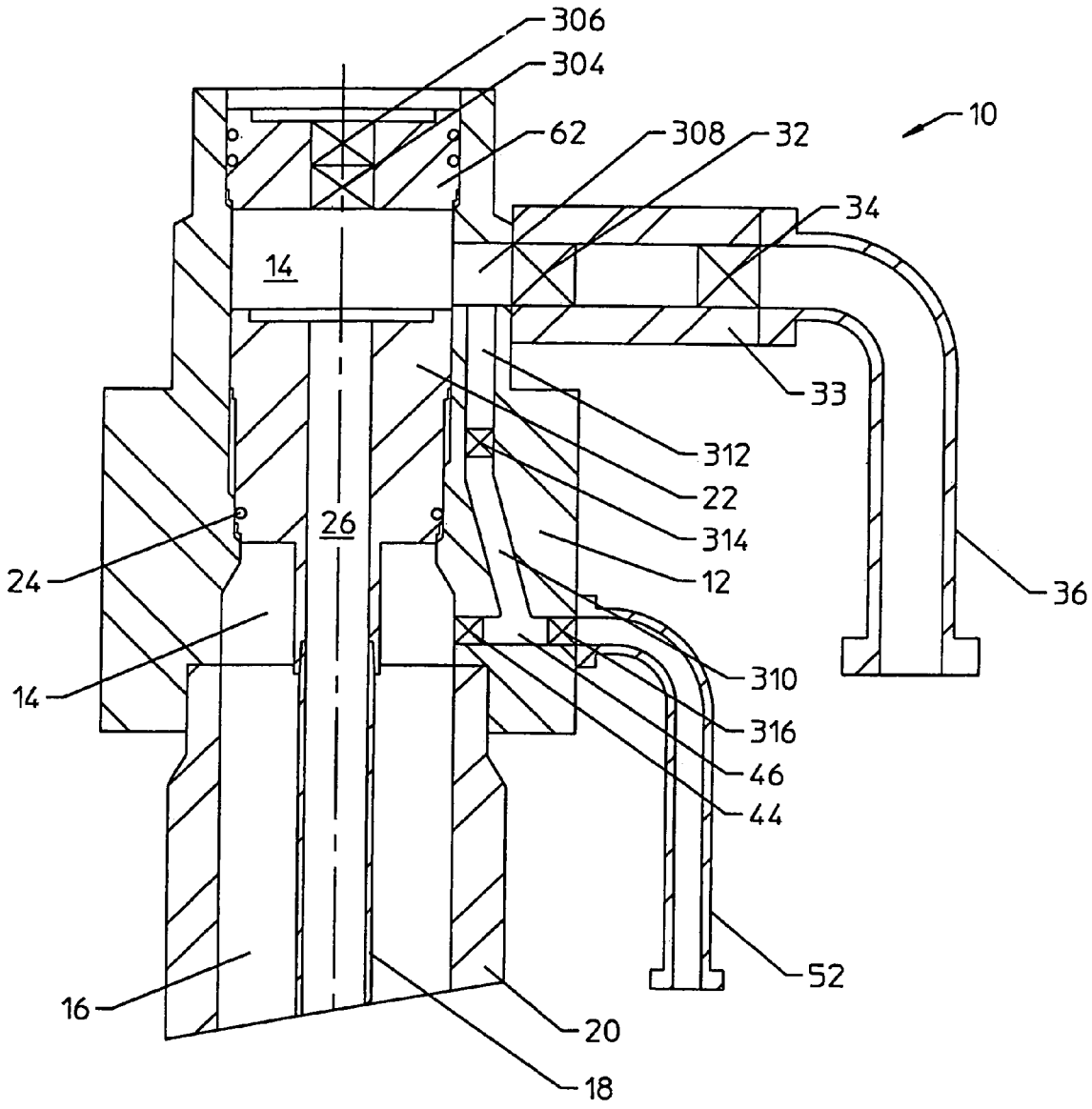
FIG. 3 illustrates a spool tree assembly wherein the spool body production passageway is provided above the tubing hanger and the annulus passageway is below the tubing hanger. The workover flow path extends entirely within the spool body from the production passageway to the annulus passageway in the spool body.
Figure 4:
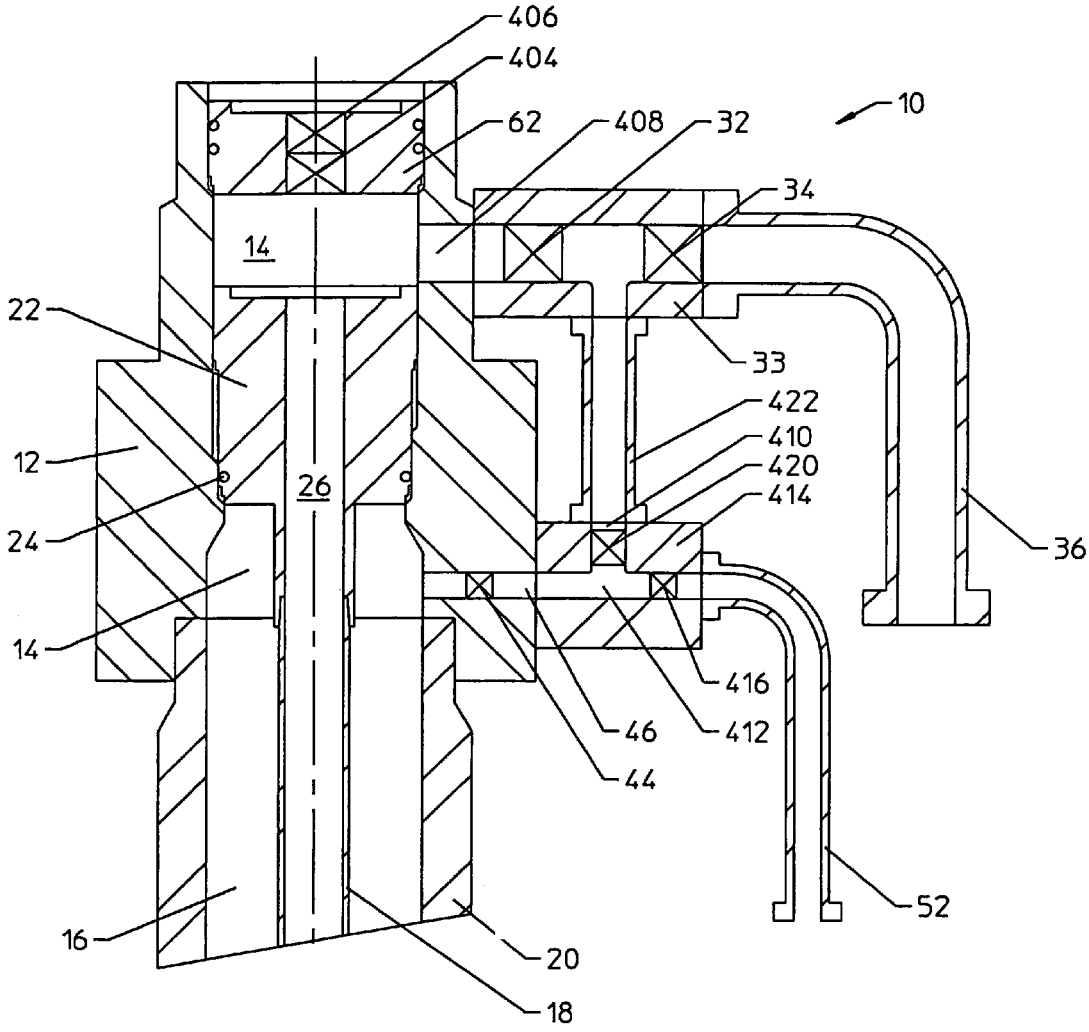

The FIG. 4 embodiment is similar to the FIG. 3 embodiment, except that the workover flow path is provided exterior of the spool body for fluid communication between first and second production valves along the production line and first and second annulus valves along the annulus line.

Figure 5:
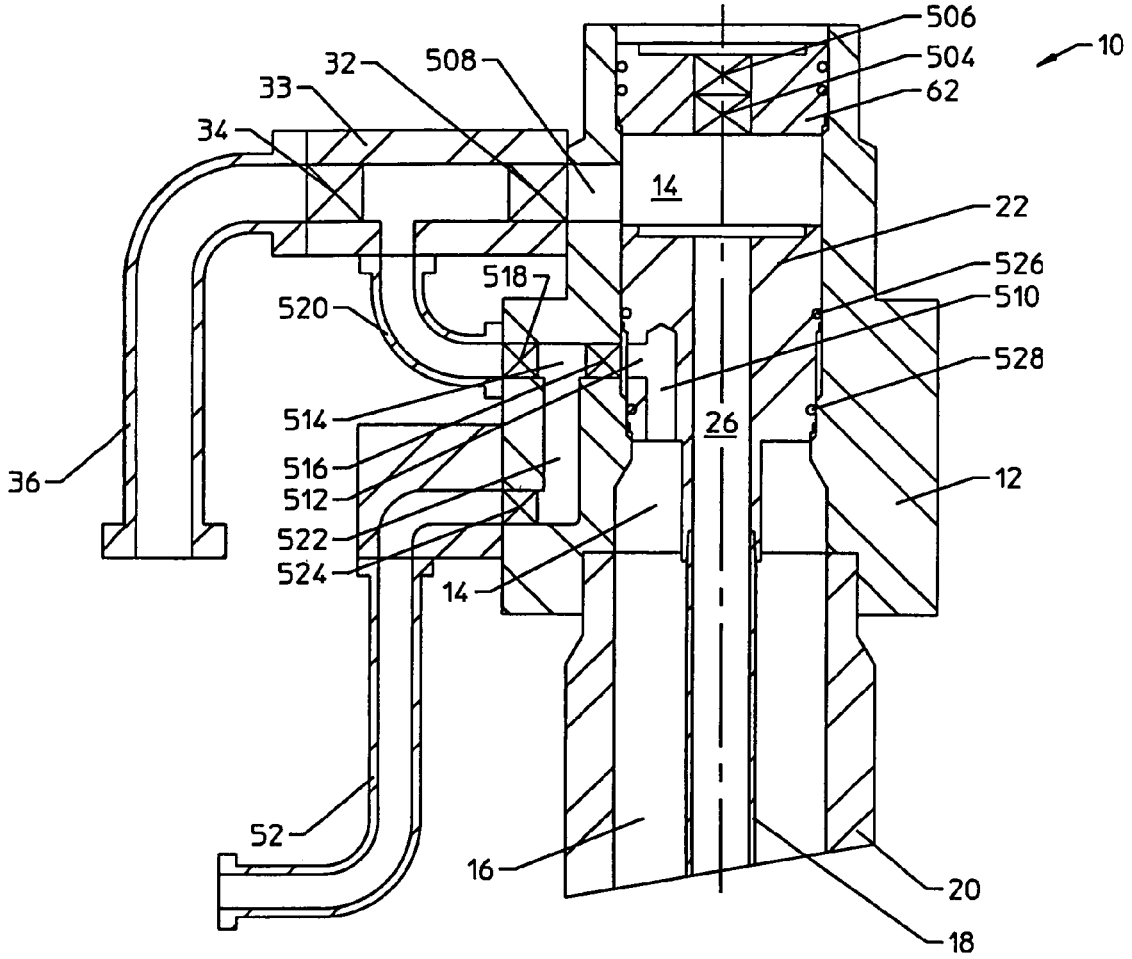

In the FIG. 5 embodiment, the horizontal spool tree assembly includes an annulus passageway extending upward into the tubing hanger and laterally outward through the tubing hanger and through the spool body to an annulus line. The spool body production passageway is provided above the tubing hanger, and a workover flow line is exterior of the spool body.

Figure 6:
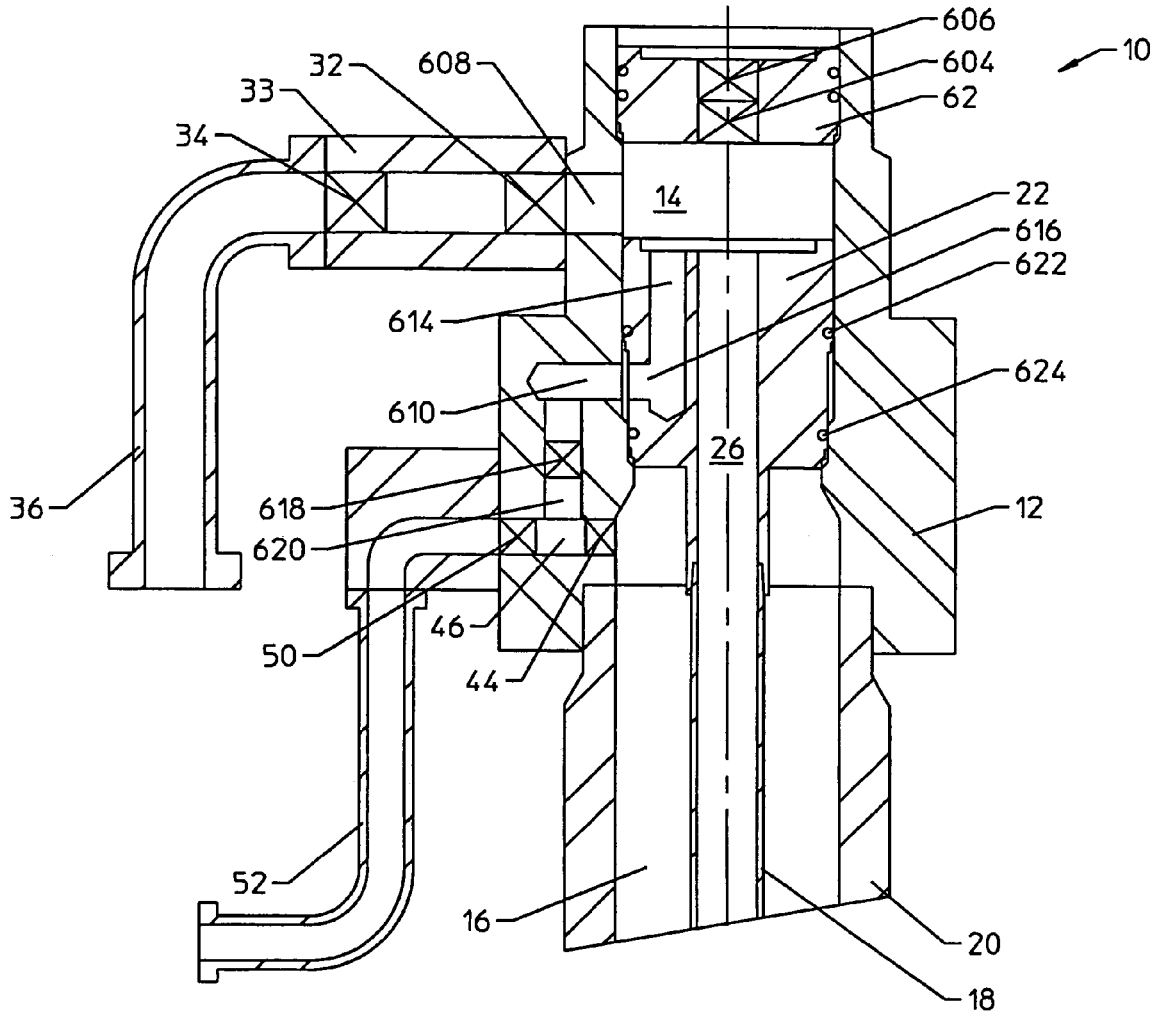

FIG. 6 depicts a horizontal spool tree assembly with a spool body production passageway above the tubing hanger. An annulus passageway below the tubing hanger extends laterally through the spool body. A workover flow path extends from the spool body central bore above the tubing hanger downward through a portion of the tubing hanger, laterally outward through the tubing hanger and into the spool body, and laterally inward through the spool body to the tubing annulus.

Figure 7:
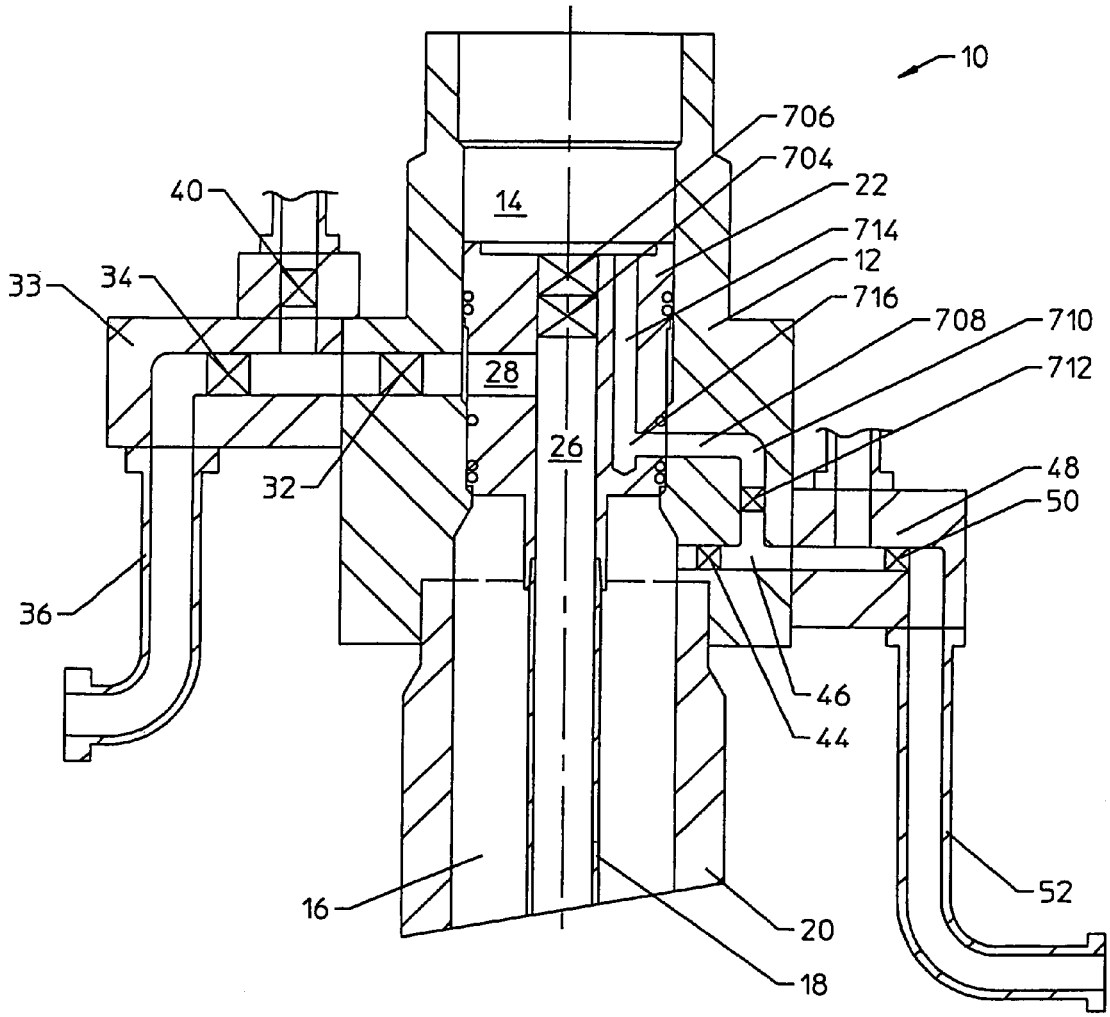

In the FIG. 7 embodiment, no tree cap is provided, and a pair of plugs are shown in the central bore of the spool body. The workover flow path extends downward through a portion of the tubing hanger, then laterally outward into the spool body for fluid communication with the annulus line and then the tubing annulus.

DETAILED DESCRIPTION OF THE PREFERRED EMBODIMENTS

Figure 1:
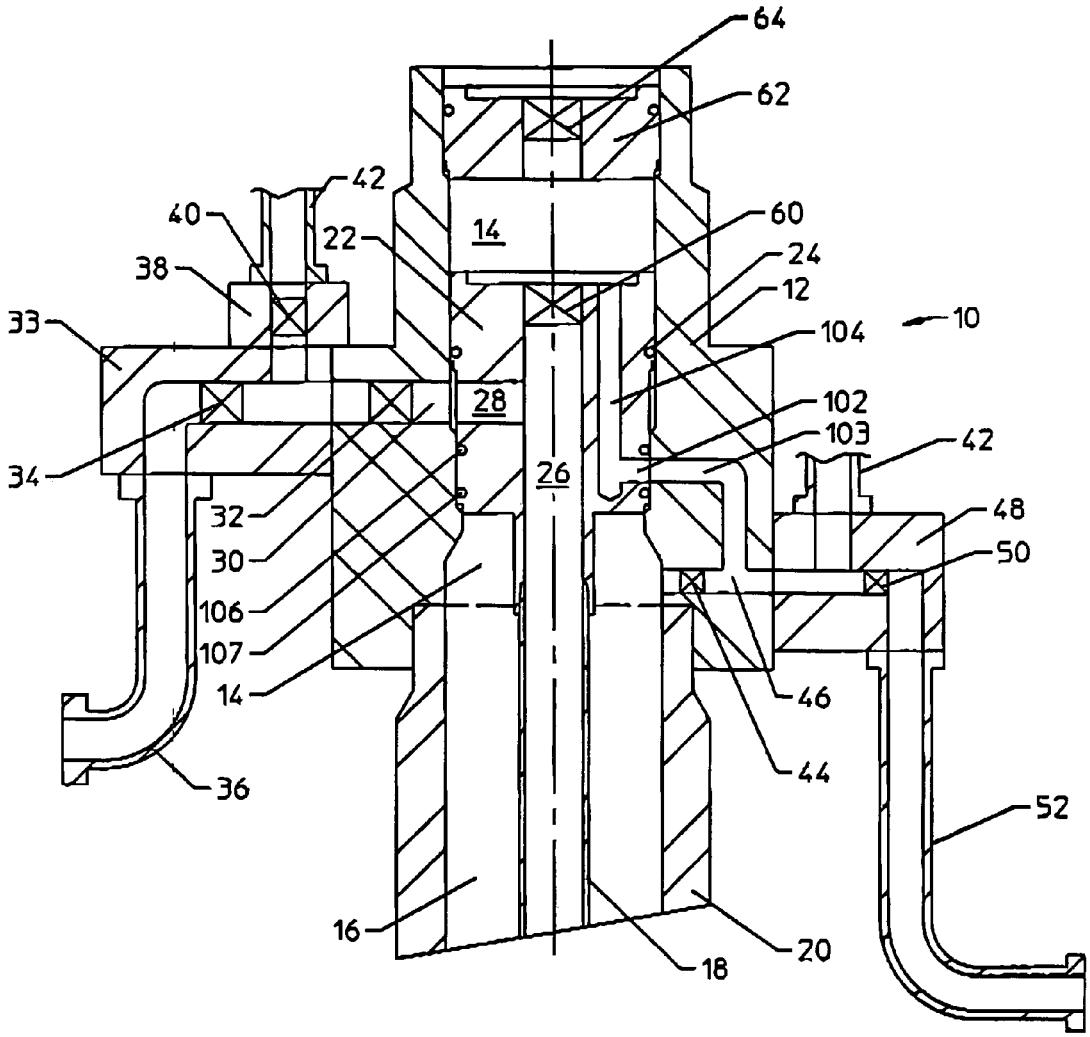
FIG. 1 illustrates a horizontal spool tree assembly with a crossover flow line in fluid communication with the annulus line between the first and second annulus valves, and with the opposing end of the crossover flow line in fluid communication with the production line between first and second production valves.

FIG. 1 illustrates a horizontal spool tree assembly 10 having a spool body or housing 12 with a vertical bore 14 in fluid communication with the tubing annulus 16. Production tubing 18 within the wellhead 20 extends upward to the tubing hanger 22, which is sealed to the housing 12 by one or more seals 24. A vertical production bore 26 in the tubing hanger 22 is thus aligned with the interior of the production tubing 18, while a lateral production bore 28 provides fluid communication between the vertical bore 26 and a horizontal bore 30 in the spool body 12. The spool body central bore thus has a generally cylindrical configuration for receiving the tubing hanger, and the interior wall of the spool body is adapted for landing the tubing hanger 22 thereon.

As shown in FIG. 1, valve 32 preferably is positioned on the housing 12 so that the closed valve seals against a seat within the spool body, and may be used to control flow from the production tubing 18, with a production block 33 sealingly connected to housing 12 and including another production valve 34 for controlling flow to the production line 36. Production line 36 may thus extend from the spool tree assembly to the production platform. A crossover block 38 is sealingly connected to production block 33, and includes a valve 40 for controlling flow from the crossover line 42 to the flow line between the first and second production valves 32 and 34.

Annulus valve 44 is preferably provided within the spool body 12, i.e., the valve seals with a seat within the spool body along flow line 46, which is in fluid communication with the tubing annulus 16. An annulus block 48 is sealingly connected to the spool body 12, and includes another valve 50 for controlling flow through the annulus block from flow line 46 to annulus line 52. Line 52 conventionally also extends to the production platform. A crossover line 42 is in fluid communication with the flow line between the valves 44 and 50, and extends to the crossover valve 40. Crossover line 42 may be used to establish fluid communication between the lateral bore 30 in the spool body and the annulus line 52.

FIG. 1 also depicts a first closure member 60, which preferably is a tubing hanger wireline plug, which closes off the upper end of the vertical passageway 26 in the tubing hanger 22. A tree cap 62 is sealingly connected to the spool body 12, and a second closure member 64 is provided in the tree cap. In this and other embodiments, a valve may be used instead of a wireline plug.

FIG. 1 illustrates the tubing annulus exiting the spool body or housing 12 via flow line 46 below the tubing hanger 22 and the tubing hanger associated seals with the spool body. This annulus port 46 then communicates with a lateral bore 102 in the tubing hanger 22, preferably by flow path 103 in housing 12. Bore 102 in turn communicates with a vertical bore 104 in the tubing hanger. Annular seals 106, 107 are positioned on the tubing hanger above and below the lateral bore 102 to seal the bore 102 in the tubing hanger from the main bore 14 in the spool body 12, and thus from the tubing annulus, and to seal bore 102 from production bore 28.

In the FIG. 1 embodiment, the crossover flow line 42 is provided between the annulus line 46 and the production line 36, and preferably connects with the annulus line between the first annulus valve 44 and the second annulus valve 50, and similarly connects the production line between the first production valve 32 and the second production valve 34. By providing the valves 44 and 32 on the spool body, fewer leak paths are provided, thereby increasing reliability. Each valve may be mounted on the spool body and/or may be set at least partially within a pocket provided within the spool body, but in either case the valve closure member seals against a seat which is provided within the spool body, so that the respective valve controls flow along a passageway which is within the spool body. During the workover operation, workover fluids may flow in a conventional manner to the vertical bore 14 above the tubing hanger, then into the vertical bore 104 and then through flow paths 102, 103 and through the open valve 44 and into the tubing annulus 16. The valve 50 remains closed to seal off the annulus line 52, and valve 40 is closed to seal off the crossover line. If desired, the valve 40 could be provided on block 48, rather than on block 38 at the opposite end of the crossover line 42.

Figure 2:
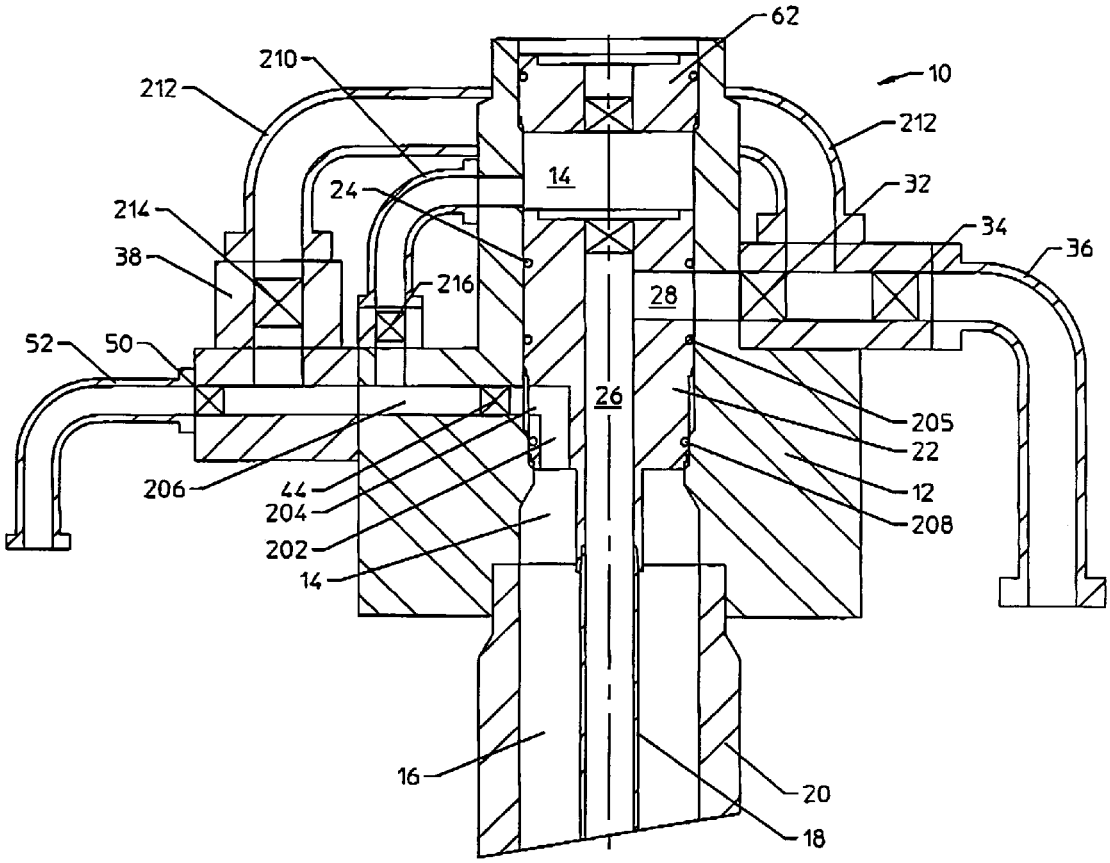
FIG. 2 illustrates a horizontal spool tree assembly with an annulus passageway extending from the tubing annulus upward through a portion of the tubing hanger and laterally through the tubing hanger and into the spool body and to the annulus line. The workover flow path is shown external of the spool body.

In the description of FIGS. 2–7 which follows, the variations of each embodiment are discussed, and the similarities will be apparent. FIG. 2 illustrates a tubing hanger 22 with a vertical production bore 26 and a lateral production bore 28. A tree cap 62 is landed in and sealed to the main spool body. The tubing annulus comes up through vertical port 202 in the tubing hanger 22, and then laterally out through port 204 in the tubing hanger, then out through lateral port 206 in the spool body 12. An annular seal 208 is positioned on the tubing hanger below the lateral port 204 to seal with the main bore in the tree head, and seal 205 isolates annulus pressure from lateral port 28 in the tubing hanger. A workover line 210 communicates with passageway 206 and the spool bore 14 above the tubing hanger 22 and below the tree cap 62. Valve 216 is provided along the crossover flow line 210. A crossover passageway 212 is provided to allow crossover flow communication between passageway 206 and the production passageway between production valves 32 and 34. Valve 214 is located along the crossover flow line 212.

By providing an annulus passageway which extends from the tubing annulus upward through a portion of the tubing hanger then laterally outward through the tubing hanger and into the spool body, impingement of fluids and solids entrained in fluids in the annulus bore occurs primarily on the tubing hanger, i.e., on the uppermost surface of the port 202. Excessive wear due to impingement may be rectified by replacing the tubing hanger, and without incurring the more significant costs of replacing or repairing the spool body 12. Also, debris entrained within the fluids in the tubing annulus 16 engages the tubing hanger before passing through the annulus valve 44, and thus may fall back into the tubing annulus. By providing a workover flow path 210 which is external to the spool body 12, the cost of manufacturing the spool tree assembly may be reduced, although additional leak paths are also provided by the external workover line 210. Valve 44 is preferably provided directly on the spool body, so that it closes off flow along the passageway 206 in the spool body. In the FIG. 2 embodiment, workover flow through line 210 may be accomplished by opening the valve 216, closing the valve 50 and opening the valve 44 to the tubing annulus 16. Crossover flow may be accomplished by opening production valve 32, closing valve 34, and flowing production fluid through the crossover line 212 to the open valve 214 and open valve 50 to line 52, with valves 44 and 216 remaining closed.

FIG. 3 illustrates a tubing hanger 22 containing a vertical production bore 26 which continuously communicates with the main bore 14 in the spool body 12 above the tubing hanger 22. There is no plug in the vertical bore of the tubing hanger. A tree cap 62 is landed in and sealed to the main spool body. A pair of plugs 304, 306 are each located and sealed to the vertical bore in the tree cap. The spool body 12 has a lateral production outlet 308 located above the tubing hanger 22 for production flow past opened valves 32 and 34 each in production block 33, then to the production line 36. The tubing annulus 16 exits the spool body below the tubing hanger 22, with valve 44 positioned within the spool body 12. The passageway 310 is provided entirely within the spool body 12, and includes vertical passageway portion 312 containing a valve 314 located in the spool body 12. The vertical passageway portion 312 intersects the lateral production passageway 308 within the spool body upstream of the first master valve 32 for controlling fluid flow along production line 36. Valve 316 preferably positioned on spool body 12 controls flow along annulus passageway 46 to annulus line 52, and may alternatively be located within a block sealingly connected to spool body 12. An annular seal 24 is positioned on the tubing hanger to seal the tubing hanger to the spool body main bore. The first master production valve 32 could alternatively be provided within the spool body 12.

In the FIG. 3 embodiment, and also in the FIGS. 4–6 embodiments, the production bore extends laterally through the spool body and is provided above the tubing hanger 22. In the FIG. 3 embodiment and the FIG. 4 embodiment discussed subsequently, the tubing hanger need not be oriented, since no lateral flow paths in the tubing hanger are provided for communication with lateral ports in the spool body. Accordingly, only a single seal 24 need be provided for sealing between the tubing hanger and the spool body. Since the tubing hanger is non-oriented, an orientation sleeve is not required, and thereby the diameter of the production bore 26 is not restricted by the requirements of an orientation sleeve. One option for each of the FIGS. 3 and 4 embodiments may be to orient the tubing hanger for a penetrator to operate a tubing safety valve, but in the alternative stab lines may be provided for passing through the tree cap and the tubing hanger, so that the tubing hanger remains non-oriented.

The configurations shown in FIGS. 3–6 thus provide alternatives to a simple yet highly reliable spool tree assembly, and one in which the production bore in the hanger need not be restricted so as not to restrict flow to the production line. Moreover, the same flow lines may be used for workover and crossover operations. In the FIG. 3 embodiment, workover may be accomplished from the bore 14 above the tubing hanger 22 through the flow paths 312 and 310, with valves 314 and 44 open for communication with the tubing annulus 16. During a crossover operation, valve 44 is closed and valve 316 is open, so that with valve 32 closed, production fluid may flow through the flow paths 312 and 310 to the annulus line 52. In the FIG. 3 embodiment, the same flow path is thus used to transmit fluid from above the tubing hanger to below the tubing hanger during both a workover and crossover operation.

FIG. 4 also illustrates a tubing hanger 22 containing a vertical production bore 26 which continuously communicates with the main bore 14 of the spool body 12 above the tubing hanger 22. There is no plug in the vertical bore of the tubing hanger. A tree cap 62 is landed in and sealed to the main spool body. A pair of plugs 404, 406 are located and sealed to the vertical bore of the tree cap. The spool body 12 has a lateral production outlet 408 located above the tubing hanger 22 for production flow past opened valves 32 and 34 each in the production block 33, then to production line 36. The tubing annulus exits the spool body 12 below the tubing hanger 22 through flow path 46, with valve 44 positioned on the spool body 12. The annulus flow path 46 then communicates with flow passageway 412 in block 414, which is sealingly connected to spool body 12. Valve 416 controls fluid flow to annulus line 52. Vertical passageway 410 in block 414 intersects the flow passageway 412 in block 414, with valve 420 preferably positioned on block 414 for controlling flow from passageway 412 to flow line 422, which is sealingly connected to production block 33 downstream of the first master valve 32 and upstream of the second master valve 34. The flow line 422 is thus sealed to blocks 414 and 33. An annular seal 24 is positioned on the tubing hanger to seal the tubing hanger to the main bore at the spool body. Redundant closure members are provided in the tree cap.

The FIG. 4 embodiment is similar to the FIG. 3 embodiment, except that workover line 422 is provided between the production valves 32 and 34, and is external to the spool body 12. With valves 34 and 416 closed, workover is accomplished by opening valves 32 and flowing fluid through workover line 422 and past open valves 420 and 44 to the annulus 16. Crossover flow is accomplished along the same line 422, with valve 32 open and valve 34 closed, and valve 44 closed and valves 420 and 416 open to maintain communication with the annulus line 52.

The tubing hanger 22 as shown in FIG. 5 contains a vertical production bore 26 which again continuously communicates with the main bore 14 in the spool body 12 above the tubing hanger 22. There is no plug in the vertical bore of the tubing hanger. A tree cap 62 is landed in and sealed to the main spool body. A pair of plugs 504, 506 are located and sealed to the vertical bore of the tree cap. The spool body 12 has a lateral production outlet 508 located above the tubing hanger 22 for production flow. Valves 32 and 34 in production block 33 control flow along production line 36, as previously discussed. The tubing annulus communicates with a vertical bore 510 in the bottom of the tubing hanger 22, which intersects a lateral bore 512 in the tubing hanger 22. This lateral bore 512 communicates with a lateral annulus passageway 514 in the spool body 12, with valve 516 located on the spool body 12 for controlling flow from port 512 to valve 518, which preferably is also located on the spool body 12. Valve 518 controls flow to crossover line 520, which is sealingly connected on one end to spool body 12, and at the other end to production block 33 at a location fluidly between valves 32 and 34. Passageway 522 in spool body 12 fluidly connects passageway 514 with valve 524 on the spool body, which controls flow to annulus line 52. A pair of annular seals 526, 528 are positioned on the tubing hanger above and below port 512 to seal the tubing hanger with the main bore of the spool body. The spool body assembly is otherwise similar to the embodiment previously discussed.

The FIG. 5 embodiment has a lateral production passageway through the spool body above the tubing hanger 22, although the tubing hanger must be oriented to align the passageway 510 in the tubing hanger with the passageway 514 in the spool body 12 for passing annulus fluid upward through a portion of the tubing hanger then laterally outward. This embodiment has the same advantages of a FIG. 2 embodiment, since fluid will impinge upon the inner wall of the tubing hanger, and debris is likely to fall back into the tubing annulus before passing through the annulus passageway 514. During the workover operation, valves 34 and 524 are closed, and valves 32, 518 and 516 are open so that workover fluid flows through the line 520 and into the tubing annulus 16. During a crossover operation, valve 34 remains closed and valve 32 open, but now valve 516 is closed and valves 518 and 524 are open to maintain communication between the production line and the annulus line.

FIG. 6 illustrates a tubing hanger 22 containing a vertical production bore 26 which continuously communicates with the main bore 14 of the spool body 12 above the tubing hanger 22. There is no plug in the vertical bore of the tubing hanger. A tree cap 62 is landed in and sealed to the main spool body. A pair of plugs 604, 606 are located and sealed to the vertical bore of the tree cap 62. The spool body 12 has a lateral production outlet 608 located above the tubing hanger 22 for production flow to opened valves 32 and 34, then to production line 36. The tubing annulus exits the spool body through a first lateral flow path 46 below the tubing hanger 22, with valve 44 positioned on housing 12 along flow path 46. Valve 50 in this embodiment is also shown positioned on spool body 12. This annulus fluid flow path 46 also communicates with a second lateral annulus flow path 610 in the spool body 12. The tubing hanger contains a vertical bore 614 which communicates with the bore 14 in the spool body above the tubing hanger 22, and which intersects a lateral bore 616 in the tubing hanger 22. The lateral bore 616 is in alignment with and thus communicates with the second lateral bore 610 in the spool body. Valve 618 along passageway 620 connecting the first 46 and the second 610 lateral flow paths in the spool body controls flow between the bore 14 in the spool body above the tubing hanger and lateral annulus fluid flow path 46. A pair of annular seals 622, 624 are positioned on the tubing hanger 22 to seal the tubing hanger to the spool body main bore above and below the lateral bore 616 in the tubing hanger.

The FIG. 6 embodiment also provides a lateral production bore through spool body 12 above the tubing hanger. Valve 32 may remain closed for both a workover or a crossover operation. During a workover operation, fluid flows downward through the tubing hanger bore 614 and out into the lateral bore 610 in the spool body 12, then downward past the open valve 618 and through valve 44 into the tubing annulus 16, with valve 50 being closed. Substantially the same flow path is used for a crossover operation, but in this case valve 44 is closed and valve 50 is open, so that communication is maintained between the bore 14 above the tubing hanger 14 and the annulus line 52.

In FIG. 7, a tubing hanger 22 contains a vertical production bore 26 and a lateral production bore 28 similar to the FIG. 1 embodiment. A pair of plugs 704, 706 are located and sealed to the vertical production bore 26 of the tubing hanger 22. The tubing annulus exits the spool body 12 through lateral flow path 46 below the tubing hanger 22, with valve 44 located along the flow path 46 and preferably within the spool body. Valve 50 in block 48 controls flow to annulus line 52. Spool body 12 also includes a vertical bore 710 which intersects horizontal bore 708 extending radially inward to an interior of the housing 12. Valve 712 is preferably provided on the spool body along one of the bores 708, 710 for controlling flow from the flow path 46 downstream from the valve 44 to a corresponding bore 716 provided in the tubing hanger 22. The bore 46 also communicates with a second lateral flow path 708 in the spool body. The tubing hanger 22 contains a vertical annulus bore 714 which communicates between the primary bore 14 in the tree housing 12 above the tubing hanger 22 and the lateral bore 716 in the tubing hanger 12, which intersects the lateral annulus bore 708 in the spool body 12.

The FIG. 7 embodiment is similar to the FIG. 1 embodiment, except that both valves 706 and 704 are provided in the tubing hanger, and the tree cap is eliminated. While this provides for less components without a tree cap, the tubing hanger will have to be pulled if either of the plug seats becomes damage to the extent that the plug does not reliably seal with the seat. As an alternative, valves may be provided in the tubing hanger to replace the plugs 704 and 706. Crossover flow and workover flow may be accomplished in a manner similar to the FIG. 1 embodiment. As with the other embodiments, the crossover flow lines are closely adjacent the spool body, or are within the spool body, and thus are located within twelve feet of the production bore 26.

While preferred embodiments of the present invention have been illustrated in detail, it is apparent that other modifications and adaptations of the preferred embodiments will occur to those skilled in the art. The embodiments shown and described are thus exemplary, and various other modifications to the preferred embodiments may be made which are within the spirit of the invention. Accordingly, it is to be expressly understood that such modifications and adaptations are within the scope of the present invention, which is defined in the following claims.

What is claimed is:

1. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, and a spool body production passageway extending laterally from the spool body central bore for fluid communication with a production line;

the tubing hanger within the spool body central bore and sealed to the spool body, the tubing hanger adapted to support the production tubing string therefrom, the tubing hanger having a tubing hanger production bore for fluid communication with the production tubing string and a tubing hanger production passageway extending laterally from the tubing hanger production bore for fluid communication with the production passageway in the spool body;

an annulus passageway extending laterally through the spool body below the tubing hanger for fluid communication with the tubing annulus;

a first annulus valve for controlling fluid flow between the tubing annulus and an annulus line;

a second annulus valve positioned downstream from the first annulus valve with respect to the tubing annulus for controlling fluid flow between the tubing annulus and the annulus line;

a workover flow path in fluid communication with the annulus passageway and passing through the spool body, laterally into the tubing hanger, and upward through the tubing hanger to the spool body central bore above the tubing hanger, thereby providing fluid communication between the workover string and the tubing annulus;

a crossover flow line in fluid communication with the annulus line between the first and second annulus valves and the production line;

a crossover valve positioned along the crossover flow line; and a workover flow path in fluid communication with the annulus passageway between the first and second annulus valves, such that the first annulus valve controls fluid flow during a workover operation.

2. A horizontal spool tree assembly as defined in claim 1, further comprising:

a production valve positioned on the spool body for controlling fluid flow along the spool body production passageway.

3. A horizontal spool tree assembly as defined in claim 2, further comprising:

the crossover flow line is in communication with the production line downstream from the production valve.

4. A horizontal spool tree assembly as defined in claim 1, wherein the workover flow path extends through a lateral port in the tubing hanger spaced below the tubing hanger production passageway.

5. A horizontal spool tree assembly as defined in claim 1, further comprising:

a first closure member positioned within the tubing hanger production bore in the tubing hanger.

6. A horizontal spool tree assembly as defined in claim 5, further comprising:

a second closure member positioned above the tubing hanger and the first closure member for isolating the spool body central bore between the first and second closure members.

7. A horizontal spool tree assembly as defined in claim 1, further comprising:

another production valve on a block connected to the spool body for controlling fluid flow along the production line.

8. A horizontal spool tree assembly as defined in claim 1, further comprising:

a lower first seal between the tubing hanger and the spool body;

an intermediate second seal between the tubing hanger and the spool body;

a third upper seal between the tubing hanger and the spool body;

the workover flow path into the tubing hanger being spaced between the first seal and the second seal, and the tubing hanger production passageway being spaced between the second seal and third seal.

9. A horizontal spool tree assembly as defined in claim 1, wherein the second annulus valve is positioned within a block connected to the spool body.

10. A horizontal spool tree assembly as defined in claim 1, wherein the first annulus valve is positioned on the spool body for controlling fluid flow along the fifst annulus passageway through the spool body.

11. A horizontal spool tree assembly as defined in claim 1, further comprising:

a first closure member positioned within the tubing hanger production bore in a tubing hanger;

a second closure member positioned within the tubing hanger production bore in the tubing hanger above the first closure member; and a workover valve is positioned along the workover flow path for controlling fluid flow to the first annulus valve during a workover operation.

12. A horizontal spool tree assembly as defined in claim 11, wherein the workover valve is positioned on the spool body for controlling fluid flow along the workover flow path.

13. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, and a spool body production passageway extending laterally from the spool body central bore for fluid communication with a production line;

a tree cap structurally separate from the tubing hanger and positioned within the spool body central bore above the tubing hanger;

the tubing hanger within the spool body central bore and sealed to the spool body, the tubing hanger adapted to support the production tubing string therefrom, the tubing hanger having a tubing hanger production bore for fluid communication with the production tubing string and a tubing hanger production passageway extending laterally from the tubing hanger production bore for fluid communication with the production passageway in the spool body;

an annulus passageway extending from the tubing annulus upward through a portion of the tubing hanger and laterally through the tubing hanger into the spool body and to an annulus line; and an annulus valve for controlling the fluid flow along the annulus passageway.

14. A horizontal spool tree assembly as defined in claim 13, further comprising:

a workover flow path exterior of the spool body and in fluid communication with the annulus passageway and extending through a lateral port in the spool body to the spool body central bore above the tubing hanger.

15. A horizontal spool tree assembly as defined in claim 13, further comprising:

a production valve positioned on a block exterior of the spool body for controlling fluid flow along the production line.

16. A horizontal spool tree assembly as defined in claim 13, further comprising:

a crossover flow line in fluid communication with the annulus line and the production line.

17. A horizontal spool tree assembly as defined in claim 13, further comprising:

a first closure member positioned within the tubing hanger production bore in the tubing hanger.

18. A horizontal spool tree assembly as defined in claim 17, further comprising:

second closure member positioned above the tubing hanger and the first closure member for isolating the spool body central bore between the first and second closure members.

19. A horizontal spool tree assembly as defined in claim 17, wherein the annulus valve is positioned on the spool body.

20. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, a spool body production passageway above the tubing hanger extending laterally through the spool body to a production line, and an annulus passageway below the tubing hanger extending laterally through the spool body for fluid communication between the tubing annulus and an annulus line;

the tubing hanger sealed to the spool body and adapted to support the production tubing therefrom, the tubing hanger having a tubing hanger production bore extending axially therethrough for fluid communication between the production tubing string and the spool body production passageway; and a workover flow path extending entirely within the spool body from the production passageway in a spool body to the annulus passageway in a spool body.

21. A horizontal spool tree assembly as defined in claim 20, further comprising:

an annulus valve positioned on the spool body for controlling fluid flow along the annulus passageway.

22. A horizontal spool tree assembly as defined in claim 20, further comprising:

a first closure member and a second closure member each positioned in a tree cap above the tubing hanger.

23. A horizontal spool tree assembly as defined in claim 20, further comprising:

a production valve on a block exterior of the spool body for controlling the fluid flow along from the spool body production passageway to the production line.

24. A horizontal spool tree assembly as defined in claim 20, further comprising:

a workover valve positioned on the spool body for controlling the fluid flow along the workover flow path.

25. A horizontal spool tree assembly as defined in claim 20, further comprising:

a workover flow path exterior of the spool body for fluid communication between the production line and the annulus line.

26. A horizontal spool tree assembly as defined in claim 25, further comprising:

a workover valve exterior of the spool body for controlling the fluid flow along the workover flow path.

27. A horizontal spool tree assembly as defined in claim 25, further comprising:

a first production valve for controlling fluid flow along the production line;

a second production valve for controlling fluid flow along the production line; a first annulus valve for controlling fluid flow between the tubing annulus and the annulus line;

a second annulus valve for controlling fluid flow between the tubing annulus and the annulus line; and a workover flow path is in fluid communication with the production line between the first production valve and the second production valve, and is in fluid communication with the annulus line between the first annulus valve and the second annulus valve.

28. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, a spool body production passageway above the tubing hanger extending laterally through the spool body to a production line, and an annulus passageway below the tubing hanger extending laterally through the spool body for fluid communication between the tubing annulus and an annulus line;

the tubing hanger sealed to the spool body and adapted to support the production tubing string therefrom, the tubing hanger having a tubing hanger production bore extending axially therethrough for fluid communication between the production tubing string and the spool body production passageway;

a first annulus valve for controlling fluid flow between the tubing annulus and the annulus line;

a second annulus valve positioned downstream from the first annulus valve with respect to the tubing annulus for controlling the fluid flow between the tubing annulus and the annulus line; and a fluid flow path in fluid communication with the spool body central bore above the tubing hanger and the annulus passageway between the first annulus valve and the second annulus valve, the fluid flow path providing a workover flow path for fluid communication between the workover string and the tubing annulus when the first annulus valve is open and the second annulus valve is closed, and the fluid flow path further providing a crossover flow path for fluid communication between the production line and the annulus line when the first annulus valve is closed and the second annulus valve is open.

29. A horizontal spool tree assembly as defined in claim 28, further comprising:

the fluid flow path extending entirely within the spool body from the production passageway in the spool body to the annulus passageway in the spool body.

30. A horizontal spool tree assembly as defined in claim 28, wherein the fluid flow path is in communication with the spool body production passageway between the spool body central bore above the tubing hanger and a production valve for controlling fluid flow to the production line.

31. A horizontal spool tree assembly as defined in claim 28, further comprising:

a control valve along the fluid flow path to control fluid flow.

32. A horizontal spool tree assembly as defined in claim 28, wherein the fluid flow path is exterior of the spool body for fluid communication between the production line and the annulus line.

33. A horizontal spool tree assembly as defined in claim 32, further comprising:

a first production valve for controlling fluid flow along the production line;

a second production valve for controlling fluid flow along the production line;

the fluid flow path is in communication with the production line between the first production valve and the second production valve.

34. A horizontal spool tree assembly as defined as claim 28, wherein the fluid flow path extends from the spool body central bore above the tubing hanger downward through a portion of the tubing hanger, then laterally outward through the tubing hanger and into the spool body, and in communication with the annulus line between the first annulus valve and the second annulus valve.

35. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, and a spool body production passageway above the tubing hanger extending laterally through the spool body to a production line;

the tubing hanger sealed to the spool body and adapted to support a production tubing therefrom, the tubing hanger having a tubing hanger production bore extending axially therethrough for fluid communication between the production tubing string and the spool body production passageway; and an annulus passageway extending upward into the tubing hanger and laterally outward through the tubing hanger and through the spool body to an annulus line;

a workover flow path exterior of the spool body and extending from the production line external of the spool body to the annulus passageway: and a workover flow path in fluid communication with the annulus line between a first annulus valve and a second annulus valve each annulus valve controlling fluid communication along the annulus line.

36. A horizontal spool tree assembly as defined in claim 35, further comprising:

a workover valve positioned along the workover line for controlling fluid flow during a workover operation.

37. A horizontal spool tree assembly as defined in claim 35, further comprising:

a first production valve and a second production valve each positioned along the production line for controlling fluid flow; and the workover flow path extends from the production line between the first and second production valves to the annulus passageway.

38. A horizontal spool tree assembly as defined in claim 35, further comprising:

a first closure member and a second closure member in a tree cap above the tubing hanger.

39. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, and a spool body production passageway above the tubing hanger extending laterally to a production line, and an annulus passageway below the tubing hanger extending laterally through the spool body for fluid communication between the tubing annulus and an annulus line;

the tubing hanger sealed to the spool body and adapted to support a production tubing string therefrom, the tubing hanger having a tubing hanger production bore extending axially therethrough for fluid communication between the production tubing string and the spool body production passageway; and a workover flow path extending from the spool body central bore above the tubing hanger downward through a portion of the tubing hanger, laterally outward through the tubing hanger and into the spool body, and laterally inward through the spool body to the tubing annulus.

40. A horizontal spool tree assembly as defined in claim 39, further comprising:

an annulus valve positioned on the spool body for controlling fluid flow along the annulus passageway.

41. A horizontal spool tree assembly as defined in claim 39, further comprising:

a workover valve positioned on the spool body for controlling the fluid flow along the workover fluid passageway.

42. A horizontal spool tree assembly as defined in claim 39, further comprising:

a first closure member and a second closure member in a tree cap above the tubing hanger.

43. A horizontal spool tree assembly as defined in claim 39, further comprising:

a production valve positioned on a block exterior of the spool body for controlling the fluid flow along from the spool body production passageway to the production line.

44. A horizontal spool tree assembly as defined in claim 39, wherein the workover flow path extending laterally inward through the spool body to the tubing annulus includes a portion of the annulus passageway in the spool body.

45. A horizontal spool tree assembly for controlling fluid flow through a production tubing string within a well, the production tubing string defining a tubing annulus surrounding the tubing string, and the tree assembly adapted for use with a workover string for fluid communication with the tree assembly, the tree assembly comprising:

a spool body defining a spool body central bore for receiving a tubing hanger therein, the spool body including an annulus passageway extending laterally through at least a portion of the spool body for fluid communication between the tubing annulus and an annulus line;

a tree cap structurally separate from the tubing hanger and positioned within the spool body central bore above the tubing hanger:

the tubing hanger adapted to support the production tubing therefrom, the tubing hanger having a tubing hanger production bore extending axially therethrough for fluid communication between the production tubing string and a spool body lateral production passageway through the spool body above the tubing hanger;

the tree cap positioned above the spool body production passageway for closing off flow through the spool body central bore the tree cap having a vertical bore therein: and first and second closure members each received within the vertical bore in the tree cap for closing off flow through the tree cap.

46. A horizontal spool tree assembly as defined in claim 45, further comprising:

a workover flow path extending at least partially through the spool body and fluidly connecting the central bore in the spool body above the tubing hanger to the tubing annulus; and a workover valve controlling fluid flow along the workover flow path.

47. A horizontal spool tree assembly as defined in claim 45, further comprising:

a production valve on a block exterior of the spool body for controlling the fluid flow from the spool body lateral production passageway to the production line.

48. A horizontal spool tree assembly as defined in claim 45, further comprising:

the production bore in tubing hanger has a substantially uniform diameter bore so as not to restrict fluid flow.

49. A horizontal spool tree assembly as defined in claim 45, further comprising:

the annulus passageway intersects the central bore in the spool body below the tubing hanger.

50. A horizontal spool tree assembly as defined in claim 45, further comprising:

the annulus passageway extends vertically through a portion of the tubing hanger, and laterally outward to the spool body.

51. A horizontal spool tree assembly as defined in claim 45, further comprising:

each of the tubing hanger production bore and the spool body production passageway being in communication with the spool body central bore between the tubing hanger and the tree cap.

* * * * *